US011407562B2

(12) United States Patent
Sprehe

(10) Patent No.: US 11,407,562 B2
(45) Date of Patent: Aug. 9, 2022

(54) CHILD RESISTANT RECLOSABLE ZIPPER ASSEMBLY

(71) Applicant: Com-Pac International, Inc., Carbondale, IL (US)

(72) Inventor: Gregory S. Sprehe, Marion, IL (US)

(73) Assignee: COM-PAC INTERNATIONAL, INC., Carbondale, IL (US)

( * ) Notice: Subject to any disclaimer, the term of this patent is extended or adjusted under 35 U.S.C. 154(b) by 0 days.

(21) Appl. No.: 16/155,572

(22) Filed: Oct. 9, 2018

(65) Prior Publication Data

US 2019/0039784 A1 Feb. 7, 2019

Related U.S. Application Data

(63) Continuation of application No. 14/530,751, filed on Nov. 1, 2014, now Pat. No. 10,099,818.

(51) Int. Cl.
*B65D 33/25* (2006.01)

(52) U.S. Cl.
CPC ..... *B65D 33/2508* (2013.01)

(58) Field of Classification Search
CPC B65D 33/2508; B65D 33/255; B65D 23/106; B65D 50/00; B65D 50/02
See application file for complete search history.

(56) References Cited

U.S. PATENT DOCUMENTS 6,167,597 B1 * 1/2001 Malin ..... B65B 61/188 24/399
6,185,796 B1 * 2/2001 Ausnit ..... B65D 33/2541 24/585.1
6,954,969 B1 10/2005 Sprehe
7,337,507 B2 3/2008 Wright et al.
7,467,893 B2 12/2008 Sprehe
7,793,391 B2 9/2010 Sprehe
7,857,514 B2 * 12/2010 Gaikwad ..... B65B 31/04 24/30.5 R
7,914,208 B2 3/2011 Sprehe
8,550,716 B2 * 10/2013 Smith ..... B65D 33/255 383/63
10,099,818 B2 10/2018 Sprehe
2006/0230588 A1 * 10/2006 Sprehe ..... A61J 9/001 24/585.12
2007/0086683 A1 * 4/2007 Yeager ..... B65D 31/10 383/95
2007/0183692 A1 * 8/2007 Pawloski ..... B65D 33/2508 383/61.2
2010/0150477 A1 * 6/2010 Bois ..... B65D 33/2508 383/42

(Continued)

*Primary Examiner* — Derek J Battisti

(74) *Attorney, Agent, or Firm* — Sandberg Phoenix & von Gontar PC

(57) ABSTRACT

A reclosable child-resistant plastic zipper assembly of manufacturer definable length is disclosed. The assembly has a first zipper strip and a second zipper strip, the zipper strips having complementary reclosure profiles. The zipper assembly lacks upper flanges, but instead terminates at a pair of closure tabs that meet at an opening point when the strips have been mated to provide the closure. The zipper strips each further include a texturized gripping region on the exterior surfaces to enable a user to open the zipper assembly. The assembly may be affixed to the upper end of a bag or other flexible container to provide child-resistant access to the contents therein.

18 Claims, 6 Drawing Sheets

(56) References Cited

U.S. PATENT DOCUMENTS

| | | | | |
|---|---|---|---|---|
| 2010/0236026 | A1* | 9/2010 | Nanba | B65D 33/2575<br>24/30.5 L |
| 2011/0103717 | A1* | 5/2011 | Kasai | B65D 33/2591<br>383/64 |
| 2015/0067993 | A1* | 3/2015 | Delasalle | B65D 33/255<br>24/585.12 |

* cited by examiner

CHILD RESISTANT RECLOSABLE ZIPPER ASSEMBLY

CROSS-REFERENCE TO RELATED APPLICATIONS

This application is a continuation of U.S. patent application Ser. No. 14/530,751, filed on Nov. 1, 2014, that issued as U.S. Pat. No. 10,099,818 on Oct. 16, 2018. The disclosure of the above application is incorporated herein by reference.

FIELD

The present disclosure relates to reclosable zipper assemblies, and more specifically, zipper assemblies being constructed of plastic and having features aimed at preventing access through the zipper by a child.

BACKGROUND

The statements in this section merely provide background information related to the disclosure and do not necessarily constitute prior art.

Extruded plastic zipper profiles are known in the art, though a need exists for zippers that possess enhanced child resistant features. Ideally such a zipper may be attached to a package having contents unsuitable for children (such as medication or toxic substances, for example) but where a resealable plastic zipper is desirable.

SUMMARY

The inventor hereof has succeeded at designing a new child-resistant reclosable zipper is disclosed, the zipper having no flanges above the zipper opening point or closure tab, and having a pair of textured gripping regions to facilitate the unique opening mechanism of the zipper. The zipper may have a variety of closure profiles, including a plurality of complementary protrusions and grooves. Those protrusions may include hook features that provide a snug closure. Additionally, a hinged zipper feature may be present to enhance the child-resistant nature of the zipper assembly. The zipper may be affixed to a bag or pouch in a variety of manners, including a transverse heat seal or adhesive.

Further aspects of the present disclosure will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

The following description of various embodiments is merely exemplary in nature and is in no way intended to limit the invention, its application, or its uses.

A new resealable zipper assembly is disclosed, this zipper having child resistant features. The zipper may include first and second complementary reclosable zipper strips. Each zipper strip includes an interlocking profile, such that the first and second zipper strips may be resealably opened and closed. The zipper may optionally provide an airtight seal along the length of the zipper, such that, when mounted on a package, the package may provide an airtight seal for the contents of the package.

The package onto which the zipper is mounted may be a bag or other flexible pouch or container, and may itself be constructed of one or more ply of plastic films or other suitable materials. In an embodiment, the package is constructed of such a material that a heat seal may be made between the zipper strips and upper edges of the walls of the package. Such a construction may include a plastic bag or a multi-layered bag with an innermost plastic film layer. In another embodiment, the package may be suitable for a hot melt or other adhesive seal between the zipper strips and the upper edges of the walls of the package. Such a construction may include bags constructed of kraft paper or clay coated paper.

The zipper may be extruded through a die from a plastic raw material, including for example polyethylene, polypropylene, polyethylene terepthalate, or other suitable plastics know in the art. The plastic may include additional additive materials such as ethylene acetate, and/or any other suitable additive know in the art, depending on desired performance and/or specifications of the zipper assembly. In some applications, colorants may be added to the plastic.

The zipper extruder apparatus may include a chilling component to cool the extruded plastic to room temperature or some other desirable temperature. Further, the first and second zipper strips may be joined together to form the full zipper assembly as the extrusion process continues, and the zipper may be fed continuously into a spool or cut into certain lengths. The zipper assembly may be of any indefinite length, including a continuous spooled supply of the zipper assembly. The zipper assembly may alternatively be of a fixed length and/or segmented, or may be provided in parallel segments on a continuous film web.

Figure 1:
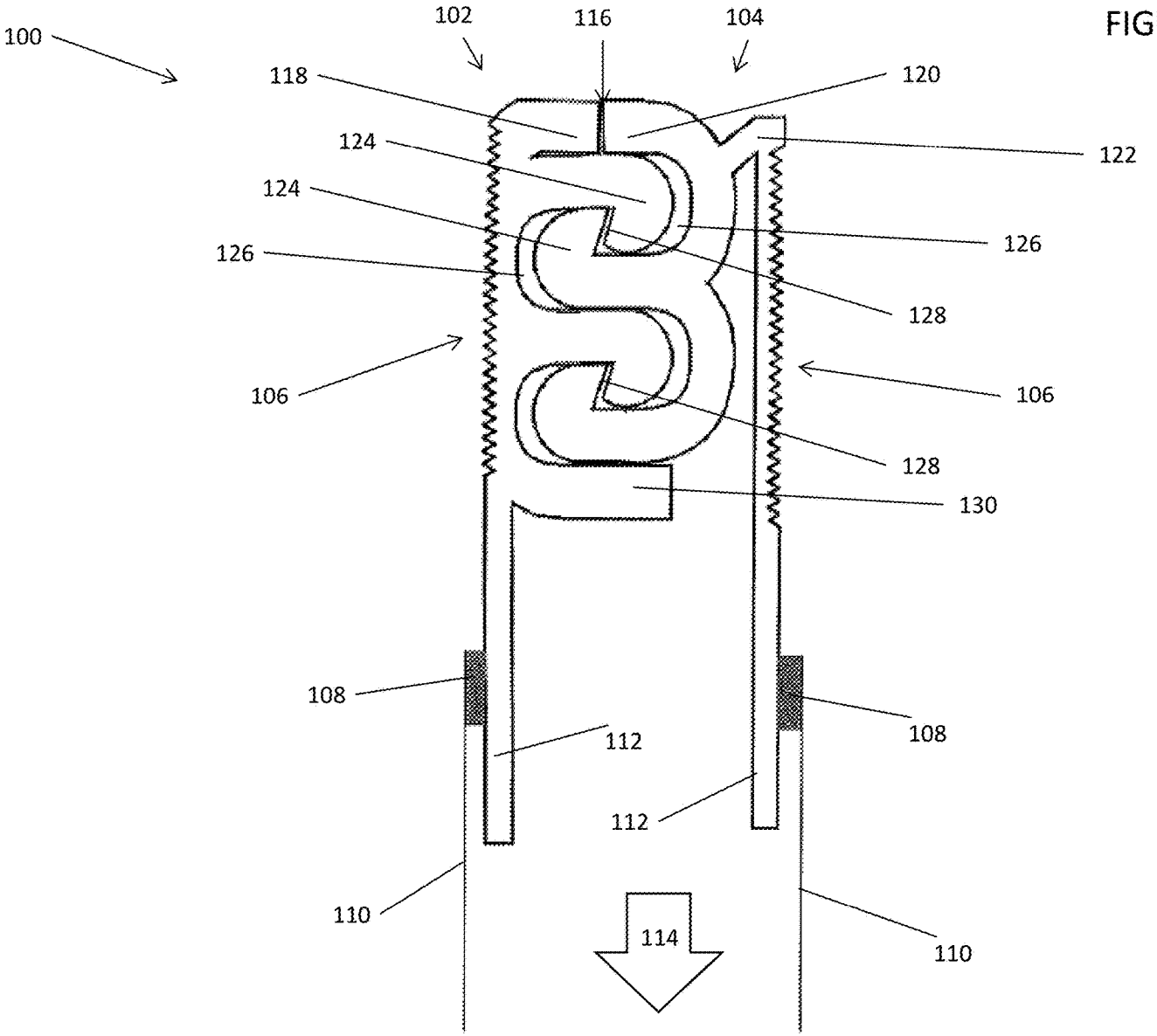
FIG. 1 shows a profile view of a first embodiment of a zipper of the disclosure, this particular zipper having a hinged zipper feature, the zipper having been affixed to a pouch.

Turning to the figures, FIG. 1 shows a cross-sectional view of a resealable zipper assembly 100, the zipper having a first zipper strip 102 and a second zipper strip 104. Each zipper strip includes a knurled or otherwise texturized gripping region 106. The texturized gripping regions may reside on the zipper strips, at or near the reclosure profiles, on the outer sides of the strips. The zipper strips may be adhered or affixed via a heat seal 108 to bag or pouch walls 110 in the upper end of the bag or pouch, the attachment being on lower flanges 112 of each zipper strip. Optionally, the texturized gripping regions of each zipper strip run the length of the zipper assembly. In this way, the zipper assembly provides access through the opened zipper to the inner contents 114 of the bag or pouch. Alternatively, the upper ends of the bag side walls, where the plastic zipper assembly is affixed to the bag, may include a texturized gripping region on the exterior surfaces.

The cross-sectional view of FIG. 1 in particular shows the detail of the interlocking and sealing features of the zipper of this disclosure. The first zipper strip 102 and the second zipper strip 104 meet at an opening point 116, which is defined by the meeting of a first closure tab 118 on the first zipper strip and a second closure tab 120 on the second zipper strip, when the zipper is closed.

The zipper of FIG. 1 includes the optional feature of a zipper hinge 122, the function of which can be seen in later figures. In this embodiment, the hinge 122 is a feature of the second zipper strip 104, though a hinge may reside on the first zipper strip, or on both zipper strips. As can be seen in the figures, the hinge is a bridge of material that separates the reclosure profile of one zipper strip from the remainder of the strip, at or near the top end of the strip. For example, in FIG. 1 the hinge separates the protrusions and grooves and closure tab of the second zipper strip from the knurled region and lower flange of the second zipper strip, where the hinge is a bridge of material that may rotate about a point at or near the top end of the second zipper strip.

The reclosure profile of the zipper assembly of this disclosure includes complementary zipper strip engagement components on each zipper strip 102, 104. Though the child resistant features of this disclosure embrace a wide variety of zipper strip engagement mechanisms and structures, a series of embodiments are seen in the figures. Returning to FIG. 1, each zipper strip 102, 104 includes a pair of protrusions 124 and a pair of grooves 126, where the protrusions and grooves are complementary in shape and provide a substantially airtight seal along the length of the zipper strip. In this embodiment, the protrusions 124 of each strip include complementary hook surfaces that meet at a hook closure region 128 to provide a snug closure and improved seal over many conventional reclosure mechanisms.

In the embodiment of FIG. 1, the uppermost groove 126 of the second zipper strip 104 is defined by the space between second closure tab 120 and an adjacent protrusion 124. Adjacent protrusions form the lower groove of the second zipper strip. Alternatively, the lowermost groove of the first zipper strip 102 is defined by the space between a lower protrusion 130 and an adjacent protrusion 124, where a lower protrusion may not necessarily include a hook surface.

The child resistant nature of the zipper assembly 100 can be seen, in part, where the first closure tab 118 and the second closure tab 120 meet at the opening point 116. This opening point does not provide any easy gripping flanges or tabs to permit the pulling apart of the two zipper strips 102, 104.

While a common feature of reclosable zipper assemblies of the prior art is a flange above the reclosure profile of each zipper strip, distal from the lower flanges, the zipper assembly of this disclosure does not include any such upper flanges. The lack of such upper flanges prevents the relatively easy opening of the zipper assembly, aiding in its child-resistant nature. To open the zipper of this disclosure, a consumer would make use of the texturized gripping regions 106. These regions facilitate opening the zipper, where a user may grip one side of the zipper with the forefinger and the other side of the zipper with the thumb, thereby pinching the zipper assembly, in a finger placement analogous to that which might be used to close a zipper by sliding one's fingers in unison along the length of a zipper assembly. However, to open the zipper of the present disclosure, once the finger and thumb are in place as described above, one may perform a "snapping" or opposing direction finger motion, thereby causing the zipper tracks to slide linearly in relation to one another in opposite directions. This action causes a slight separation of the closed alignment of the zipper assembly such that a small gap may be made in the zipper opening point 116 to allow the user to grasp the opposing zipper strips 102, 104 at their closure tabs 118, 120 and pull the zipper open, granting the user access to the interior of the bag 114.

Although the figures show the texturized gripping regions residing on the zipper strips, at or near the reclosure profiles, on the outer sides of the strips, the texturized gripping regions may reside further down the zipper assembly, as low as the lower flanges 112 or perhaps even lower. In an embodiment, the texturized gripping regions may reside on the upper end of the bag walls 110, such that the aforementioned finger placement and opening mechanism may be initiated by snapping or opposingly moving fingers on the texturized regions of the bag walls.

Figure 2:
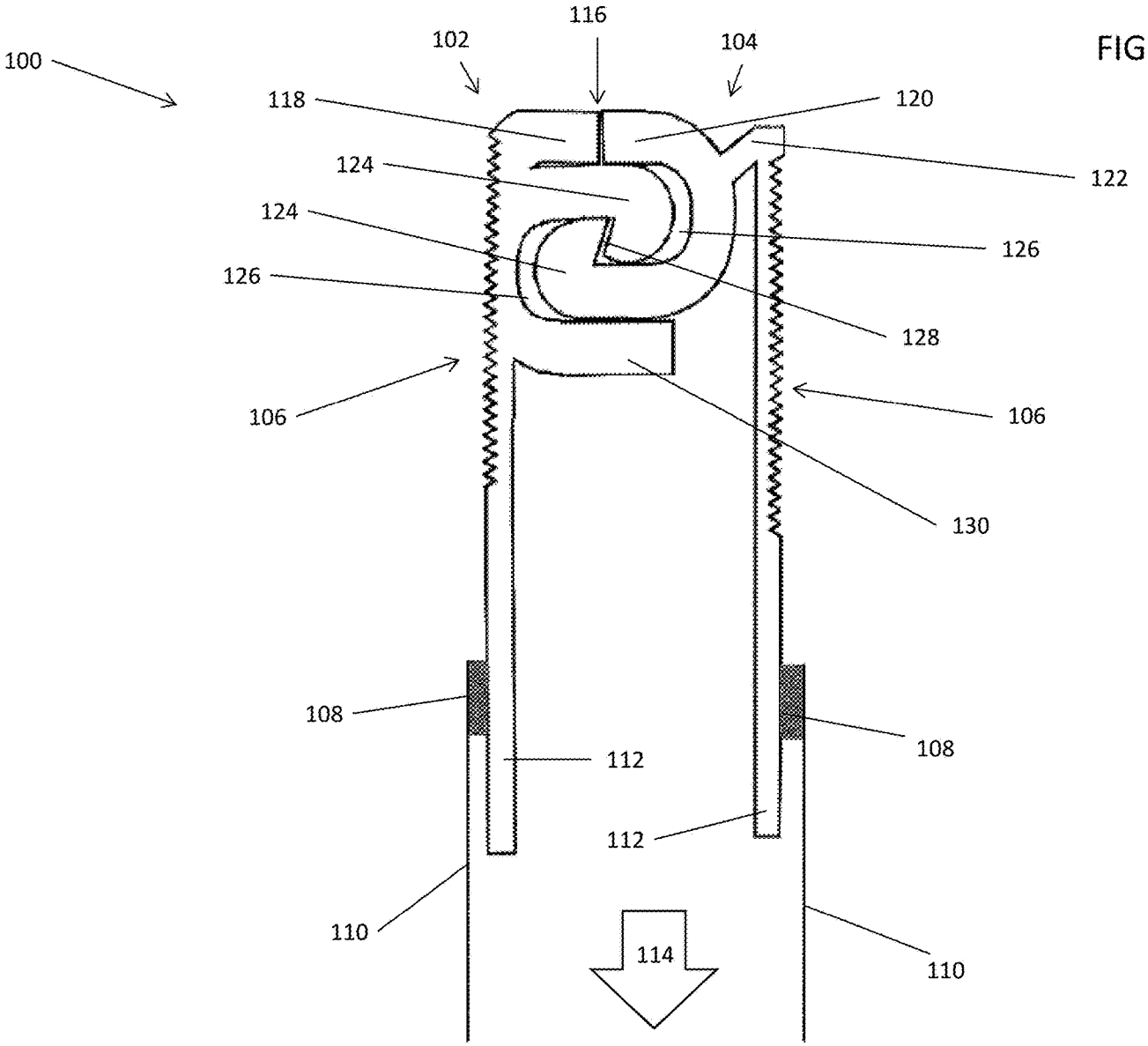
FIG. 2 shows a profile view of a second embodiment of a zipper of the disclosure, this particular zipper having a hinged zipper feature, the zipper having been affixed to a pouch.

FIG. 2 shows a profile view of a second embodiment of the reclosable zipper assembly of the disclosure. In this embodiment, each of the first zipper strip 102 and second zipper strip 104 includes only one groove 126. The groove 126 of the first zipper strip 102 is defined by a protrusion 124 and a lower protrusion 130, whereas the groove 126 of the second zipper strip 104 is defined by a protrusion 124 and the second closure tab 120. In this embodiment, the grooves 126 and protrusions 124 are complementary in shape and meet at a hook closure region 128 to provide an enhanced seal. This embodiment includes an optional hinge 122 feature, this hinge present on the second zipper strip 104.

Figure 3:
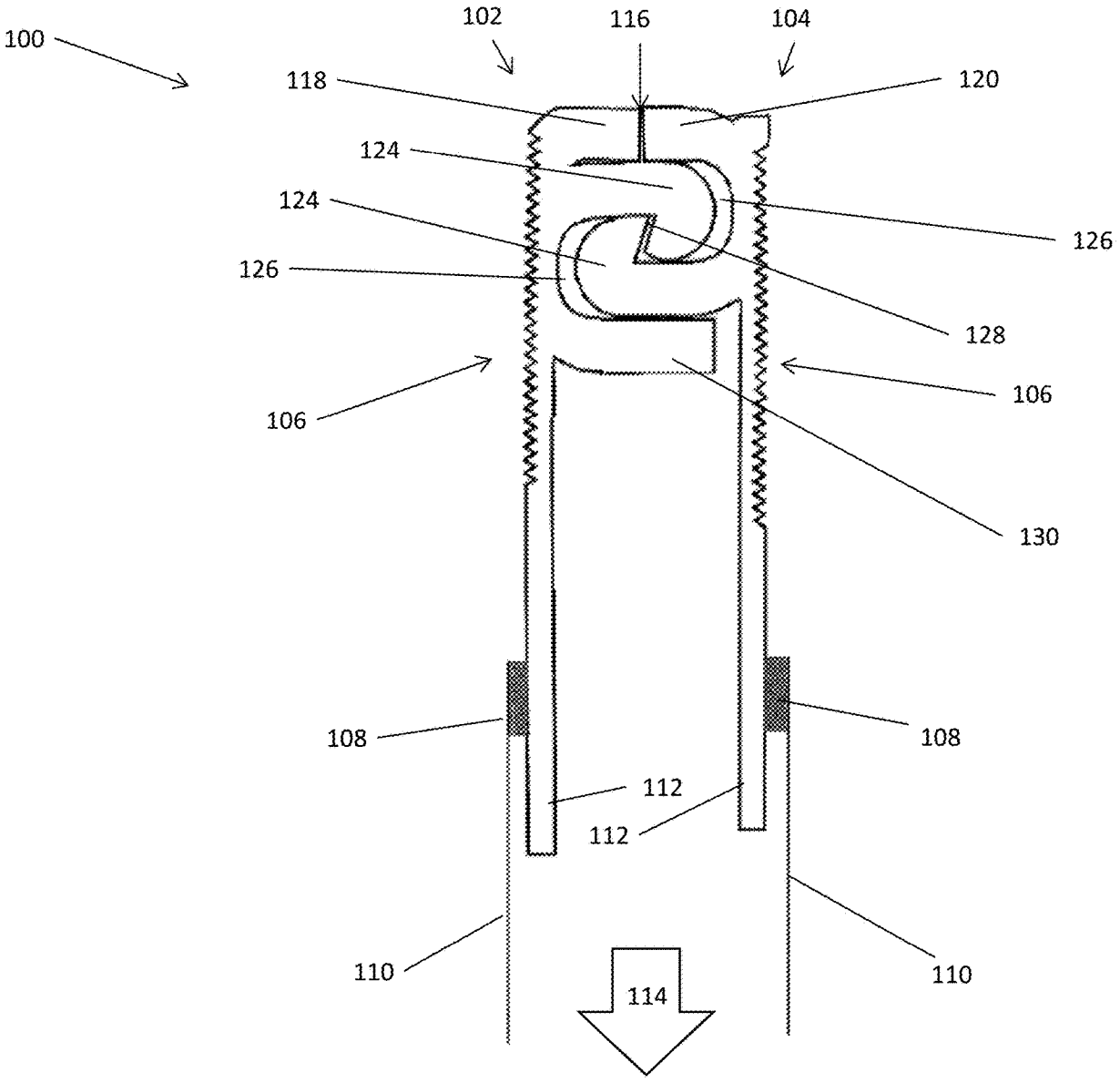
FIG. 3 shows a profile view of a third embodiment of a zipper of the disclosure, the zipper having been affixed to a pouch.

FIG. 3, viewed in comparison to FIG. 2, is distinguished in that in this third embodiment no optional hinge is present. The reclosure profile of the second zipper strip 104 is integral with the texturized gripping region 106, analogous to the arrangement on the first zipper strip 102.

Figure 4:
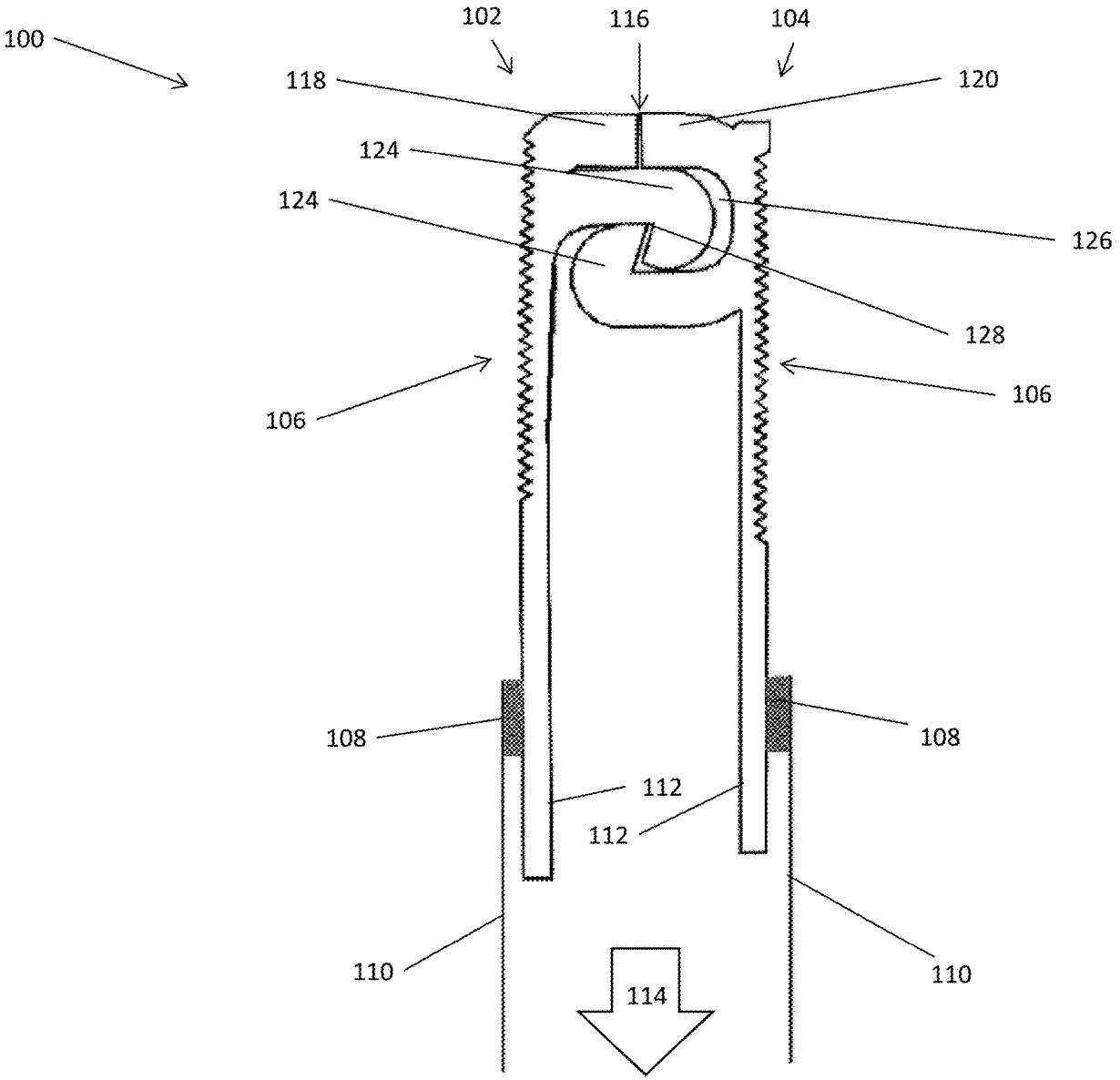
FIG. 4 shows a profile view of a fourth embodiment of a zipper of the disclosure, the zipper having been affixed to a pouch.

FIG. 4, viewed in comparison to FIG. 3, is distinguished in that in this fourth embodiment no lower protrusion 130 is present. In this way, only one groove 126 is present, residing on the second zipper strip 104 and defined by the protrusion 124 thereon and the second closure tab 120. This lone groove 126 is complementary in shape to the protrusion 124 of the first zipper strip 102. These protrusions include complementary hook surfaces that meet at a hook closure region 128 to provide a snug closure.

Figure 5:
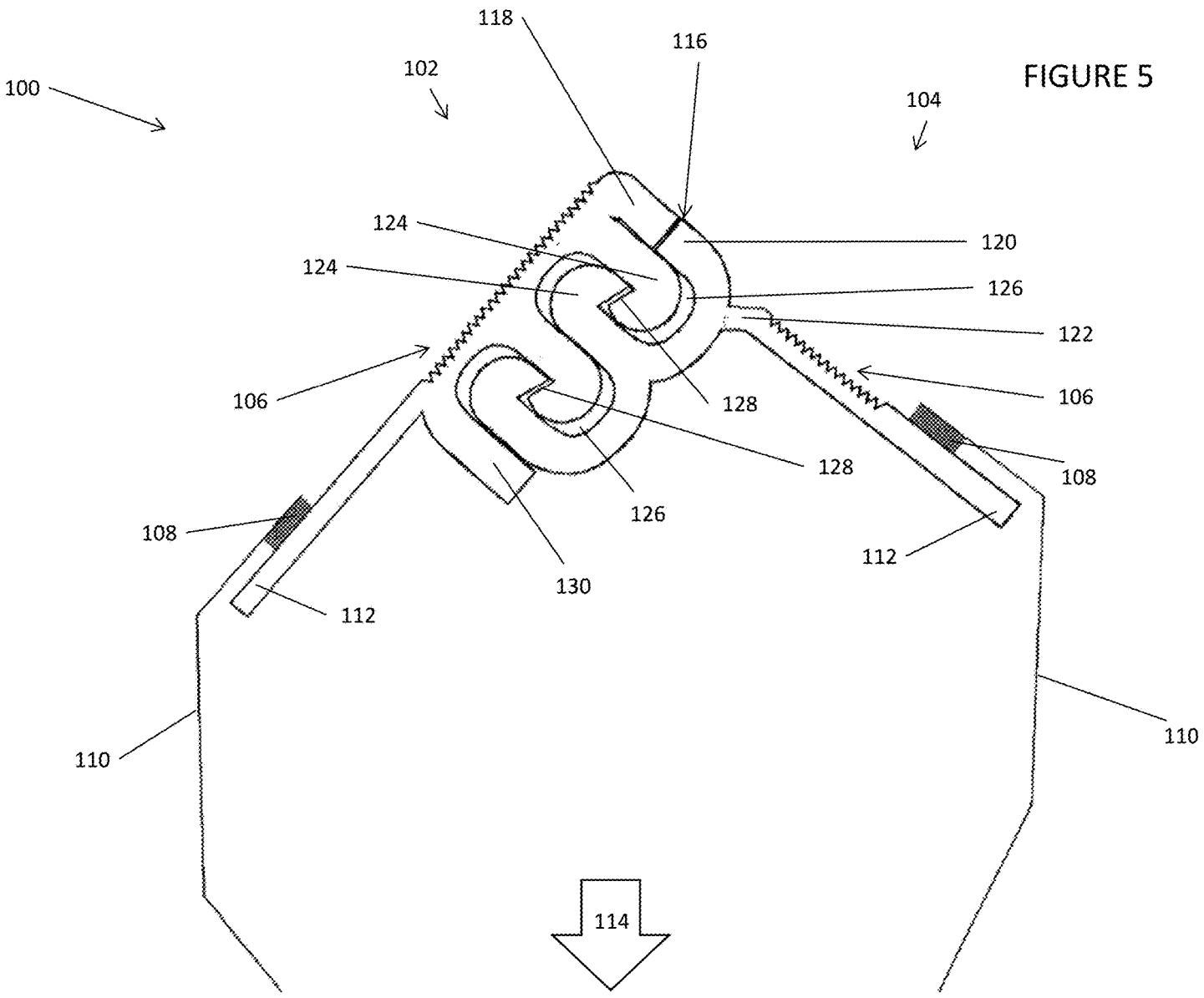
FIG. 5 shows a profile view of the embodiment of the zipper of FIG. 1, this figure detailing an optional hinged zipper feature in function during an attempt to open the pouch from below the zipper assembly.

FIG. 5 demonstrates, via a profile view of the embodiment of FIG. 1, the benefits of the optional hinge 122 feature on a zipper assembly 100. In this instance, a user has attempted to open the pouch by pulling on the side walls 110 of the container to gain access to the contents 114. The outward forces of the pulling on the side walls, however, do not cause any pulling apart of the complementary zippers 102, 104, which remain snugly engaged. Instead, the texturized gripping region 106 and flanges 112 of the second zipper strip 104 rotate away from the remainder of the zipper assembly, thereby preventing the opening of the container. While the hinge 122 is an optional feature, its presence may improve the child resistant nature of a reclosable zipper assembly of the disclosure.

Figure 6:
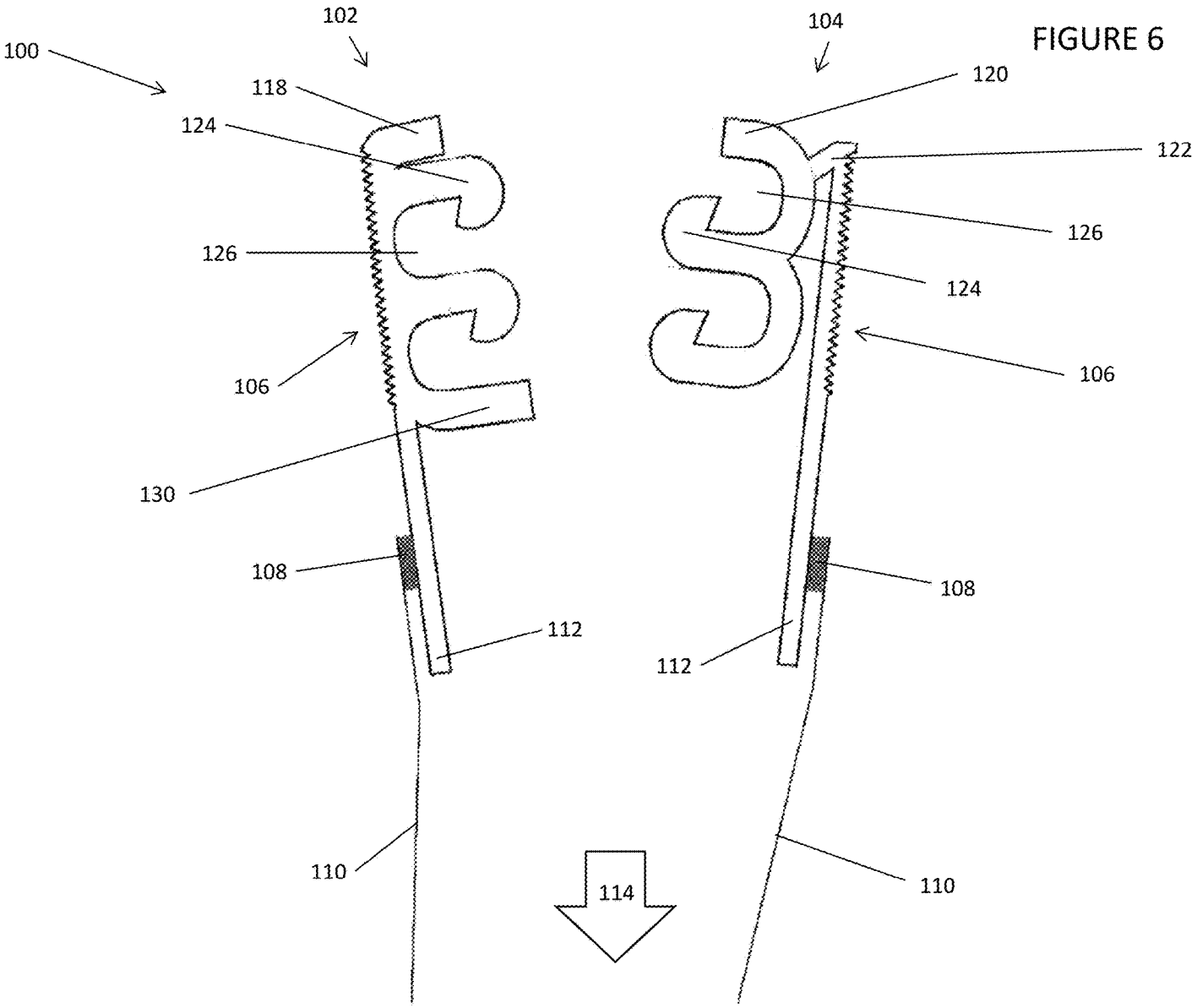
FIG. 6 shows a profile view of the embodiment of the zipper of FIG. 1, this figure showing the pouch having been opened via the successful disengagement of the two complementary sides of the resealable zipper assembly.

FIG. 6 shows the embodiment of FIG. 1, the zipper assembly 100 having been opened, granting a user access to the interior 114 of the bag onto which the zipper has been mounted.

Though not seen in the figures, a crimp seal or other mechanism for terminating and sealing off the ends of the zipper assembly may be present at each distal end of a segment of the reclosable plastic zipper assembly of indefinite length. When present, such a termination may extend downwardly through the lower flanges of each zipper strip such that the termination and heat seal in combination provide a substantially complete seal between the interior of the bag and the outside environment.

Thus, as can be seen from the foregoing description the figures, a reclosable plastic zipper assembly of indefinite length is disclosed, the assembly having a first zipper strip and a second zipper strip, each zipper strip having an upper end and an exterior surface, where the first zipper strip further includes at its upper end a first closure tab, and the second zipper strip further includes at its upper end a second closure tab. The first zipper strip includes at least one protrusion and the second zipper strip includes at least one protrusion, where the second closure tab and the at least one protrusion of the second zipper strip define a recess, the recess being complementary in shape to the at least one protrusion of the first zipper strip such that the zipper strips may be mated by inserting the at least one protrusion of the first zipper strip into the recess along the along the length of the plastic zipper strip to create a closure of the zipper assembly. In this way, the first closure tab and the second closure tab meet at an opening point when the strips have been mated to provide the closure. The zipper strips each further include a texturized gripping region on their exterior surfaces.

The disclosure additionally includes a bag having a reclosable plastic zipper assembly of the disclosure mounted thereon. In such an embodiment, the texturized region may be on the zipper assembly, as seen in the figures, or the upper ends of the bag side walls, where the plastic zipper assembly is affixed to the bag, may include a texturized gripping region.

Although the figures show only the upper side walls 110 of the bag, it should be understood that the zipper assembly 100 of this disclosure is intended to be mounted on a complete bag, or at least on a product that will at some point become a complete bag. The side walls 110 of the figures may be viewed as continuing down to a sealed bottom or an open bottom that may be sealed.

As seen in the figures, an optional hinge 122 feature is disclosed. This hinged feature, while shown in the figures, when present, as a component of the second zipper strip 104, should not be so limited. The hinge 122 may appear as a component of the first zipper strip 102, depending on the application of the zipper and the desires of the manufacturer.

It should be understood that the profile views seen in the figures are representative of the length of the zipper assembly. Where the zipper assembly has been cut into segments, it may be desirable in some applications for a heat seal, for example in the form of a crimp or a pinch, to be present on the distal lateral ends of the zipper strips such that when the zipper assembly has been opened, the distal ends of the zipper assembly remain sealed and joined.

Though the figures show the zipper strips adhered or affixed via a heat seal 108 to bag or pouch walls 110 in the upper end of the bag or pouch via the attachment being on lower flanges 112 of each zipper strip, the lower flanges may be affixed to the upper bag walls by placing the flanges outside the bag walls, whereby the zipper assembly essentially caps the bag opening. The mechanism of attachment of the zipper assembly to the bag and the spatial relationship of the lower flanges to the upper walls should not be construed as limited to only the mechanism and spatial relationship seen in the figures. A multitude of mechanisms are embraced by this disclosure, as long as the zipper assembly provides access through the opened zipper to the inner contents of the bag or pouch, while providing an effective child resistant seal while the zipper is closed.

In an embodiment, a continuous spool of the zipper 100 of the disclosure is integrated into an in-line bag manufacturing machine. An example of such a machine is one where rolled plastic film is folded, sealed, and cut into bags. Those bags may have the zipper attached to the bag via heat seal or hot melt adhesive or other conventional zipper-to-bag attachment processes. The resulting product is a bag having the disclosed zipper assembly attached thereon, as can be seen in the various figures.

In an embodiment, the geometry and arrangement of the various protrusions and grooves, including any hooks thereon when present, may be substantially congruent to one another. In an embodiment, this congruency provides a substantially airtight and/or watertight seal along the length of the zipper.

A variety of reclosure profiles may be used in conjunction with the disclosed child resistant zipper assembly, including but not limited to those seen in U.S. Pat. Nos. 7,914,208 and/or 6,954,969, both assigned to Com-Pac International, Inc., the assignee of the present application. The entireties of U.S. Pat. Nos. 7,914,208 and 6,954,969 are hereby incorporated by reference.

Possible applications for a zipper of the disclosure include the attachment of the zipper to a package having contents unsuitable for children (such as medication or toxic substances, for example). Other uses include maintaining a child resistant seal for bags that contain tobacco or *cannabis*.

The terms reclosable and resealable are used interchangeably herein. It would be understood by those of skill in the art that, as used herein, these terms generally refer to zipper assemblies that may be opened and closed repeatedly to form a substantially complete seal across the length of the zipper assembly.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention as well as all equivalents thereof.

What is claimed is:

1. A reclosable plastic zipper assembly of manufacturer definable length for attachment to a reclosable bag having two opposing side walls each with an upper end, an inner surface, an outer surface and the two opposing side walls defining an interior cavity of the bag, the zipper assembly comprising:

a first zipper strip having a first zipper length from a first end to a second end, an upper end, a lower end, an interior surface, and an exterior surface, the exterior surface of the first zipper strip having a first texturized gripping region formed thereon, the first zipper strip having the upper end defined by an upper surface of a first closure tab, the first closure tab including an inwardly protruding first tab with a first closure tab end, the first zipper strip including two or more first strip engagement protrusions on the interior surface that are opposing the exterior surface on which the first texturized gripping region is formed on the exterior surface and protruding inwardly therefrom and having an engagement end, each of the first strip engagement protrusions being spaced apart forming a recess therebetween, the first zipper strip having no flange or portion of the first zipper strip extending upward beyond the upper surface portion of the first closure tab, wherein a first upper most one of the two or more first strip engagement protrusions has an engagement member extending downward away from the upper end of the first zipper strip and an upper flat surface and is positioned adjacent to the first closure tab without having a protrusion receiving recess between the upper flat surface of the first strip engagement protrusion and the first closure tab, wherein the first texturized gripping region is formed on the exterior surface of the first zipper strip at least directly opposite each of the first closure tab and each of the plurality of two or more first strip engagement protrusions;

a second zipper strip having a second zipper length from a first end to a second end, an upper end, a lower end, an interior surface, and an exterior surface, the exterior surface of the second zipper strip having a second texturized gripping region formed thereon, the second zipper strip having the upper end defined by an upper surface of a second closure tab, the second closure tab including an inwardly protruding second tab with a second closure tab end, the second zipper strip including a plurality of second strip engagement protrusions on the interior surface that is opposing the second exterior surface on which the second texturized gripping region is formed thereon and protruding inwardly therefrom and defining recesses between the second closure tab and recesses between each of the plurality of engagement protrusions wherein the recess space each of the second closure tab and the second strip engagement protrusions apart for receiving and engaging one of the first strip engagement protrusions, each second engagement and having a complementary shape configured for selectively receiving the at least one of the two or more first strip engagement protrusions of the first zipper strip, the second zipper strip having no flange or portion of the second zipper strip extending upward beyond the upper surface portion of the second closure tab, and wherein the second texturized gripping region is formed on the exterior surface of the second zipper strip at least directly opposite each of the plurality of second strip engagement protrusions of the second zipper strip, wherein the first and second zipper strips are configured to mate by inserting each of the first strip engagement protrusion of the first zipper strip into the at least one recess of the second zipper strip along the definable length of the plastic zipper strip assembly to create a closure thereof, and wherein the first closure tab and the second closure tab are configured so that the first closure tab end abuts the second closure tab end defining an opening point that is substantially closed by such abutment when the first and second zipper strips have been mated, wherein both the first closure tab and the second closure tab are configured so that both abut against the upper surface of the first upper most first strip engagement protrusion, and wherein the first and second zipper assemblies do not have any inwardly projecting features that engage or contact or abut other than the abutting top end closure tabs and the engagement protrusions and recesses.

2. The zipper assembly of claim 1, wherein the lower ends of the first and second zipper strips includes a lower flange that extends downward from the engagement protrusions thereon.

3. The zipper assembly of claim 1, wherein each recess and each first strip engagement protrusions is complementary in shape to the recesses and second strip engagement protrusions of the second zipper strip such that the zipper strips may be mated to create a closure of the zipper assembly.

4. The zipper assembly of claim 1, wherein the texturized gripping regions of each zipper strip run the length of the zipper assembly on the exterior surfaces opposing each of the first and second closure tabs and the first engagement protrusions and second strip engagement protrusions.

5. The zipper assembly of claim 1, wherein at least one zipper strip includes a first portion having a reclosure profile that defines its engagement protrusions, a second portion that defines the outer surface, and a hinge rotatably coupling the first portion to the second portion, the hinge configured as a bridge of plastic material at or near the upper end of the that zipper strip.

6. The zipper assembly of claim 5, wherein the lower ends of the first and second zipper strips includes a lower flange that extends downward from the respective first and second engagement protrusions thereon and on the opposing top end of the zipper assemblies and being configured for attachment of the zipper assembly to each side of upper ends of the reclosable bag for defining an upper most end of the reclosable bag and wherein the hinge is proximate to the upper end of one side wall of the reclosable bag.

7. The zipper assembly of claim 5, wherein each recess and first strip engagement protrusion of the first zipper strip is complementary in shape to the recesses and second strip engagement protrusions of the second zipper strip such that the zipper strips may be mated to create a closure of the zipper assembly.

8. The zipper assembly of claim 5, wherein the texturized gripping regions of each zipper strip run the length of the zipper assembly on the exterior surfaces opposing each of the first and second closure tabs.

9. A reclosable bag assembly comprising:

a bag body defining a cavity for receiving and retaining items placed therein having two opposing side walls each with an upper end, an inner surface, an outer surface and the two opposing side walls defining an interior cavity of the bag;

a plastic zipper assembly affixed to the top ends of the two opposing side walls of the bag body to define a top end of the reclosable bag assembly to provide reclosable access to the cavity of the bag, where the plastic zipper assembly includes;

a first zipper strip having a first zipper length from a first end to a second end, an upper end, a lower end, an interior surface, and an exterior surface, the exterior surface of the first zipper strip having a first texturized gripping region formed thereon, the first zipper strip having the upper end defined by an upper surface of a first closure tab, the first closure tab including an inwardly protruding first tab with a first closure tab end, the first zipper strip including a plurality of first strip engagement protrusions on the interior surface that is opposing the exterior surface on which the first texturized gripping region is formed on the exterior surface and protruding inwardly therefrom and defining a recess between each two adjacent engagement protrusion, the first zipper strip having no flange or portion of the first zipper strip extending upward beyond the upper surface portion of the first closure tab, wherein a first upper most one of the first strip engagement protrusions has an engagement member extending downward away from the upper end of the first zipper strip and an upper flat surface and is positioned adjacent to the first closure tab without any protrusion receiving recess between the upper surface of the first strip engagement protrusion and the first closure tab, wherein the first texturized gripping region is formed on an entire first zipper strip length from the first end to the second end of the first zipper strip on the exterior surface of the first zipper strip at least directly opposite each of the at least one engagement protrusions;

a second zipper strip having a second zipper length from a first end to a second end, an upper end, a lower end, an interior surface, and the exterior surface, the exterior surface of the second zipper strip having a second texturized gripping region formed thereon, the second zipper strip having the upper end defined by an upper surface of a second closure tab, the second closure tab including an inwardly protruding second tab with a second closure tab end, the second zipper strip including a plurality of second strip engagement protrusions on the interior surface that is opposing the exterior surface on which the second texturized gripping region is formed on the exterior surface and protruding inwardly therefrom and defining a recess between each two adjacent engagement protrusion and between the second closure tab, each second strip engagement protrusion having a complementary shape configured for selectively receiving the at least one first strip engagement protrusion of the first zipper strip, the second zipper strip having no flange or portion of the second zipper strip extending upward beyond the upper surface portion of the second closure tab, wherein the second texturized gripping region is formed on the exterior surface of the second zipper strip at least directly opposite each of the plurality of second strip engagement protrusions of the second zipper strip, wherein both the first closure tab and the second closure tab are configured so that both abut against the upper surface of the first upper most first strip engagement protrusion, wherein the first and second zipper strips are configured to mate by inserting each of the plurality of first strip engagement protrusion of the first zipper strip into the recesses of the second zipper strip along the definable length of the plastic zipper strip assembly to create a closure thereof, and wherein the first closure tab and the second closure tab are configured so that the first closure tab end abuts the second closure tab end defining an opening point that is substantially closed by such abutment when the first and second zipper strips have been mated, and wherein the zipper assembly is affixed to the top end of the bag so that when the first and second zipper strips have been mated, the first and abutted first and second closure tab ends define the top end of the bag, and no portion of the bag extends upward or beyond the abutted first and second closure tab ends, and wherein the first and second zipper assemblies do not have any inwardly projecting features that engage or contact or abut other than the abutting top end closure tabs and the engagement protrusions and recesses.

10. The bag of claim 9, wherein the second zipper strip includes a first portion having a reclosure profile that defines its engagement protrusions, a second portion that defines the outer surface, and a hinge rotatably coupling the first portion to the second portion, the hinge configured as a bridge of plastic material at or near the upper end of the second zipper strip and defining the second side of the top end of the reclosable bag assembly.

11. The bag of claim 9, wherein each recess and first strip engagement protrusion of the first zipper strip is complementary in shape to the recesses and the second strip engagement protrusions of the second zipper strip such that the zipper strips may be mated to create a closure of the zipper assembly.

12. A reclosable bag assembly comprising:

a bag body defining a cavity for receiving and retaining items placed therein having two opposing side walls each with an upper end, an inner surface, an outer surface and the two opposing side walls defining an interior cavity of the bag;

a plastic zipper assembly having lower flanges extending downward that are affixed to an upper end of the bag body to define a top of the reclosable bag assembly and to provide reclosable access to the interior of the bag, wherein neither opposing side wall of the bag body extends above the plastic zipper assembly, the plastic zipper assembly including a first zipper strip and a second zipper strip, the second zipper strip having a second zipper length from a first end to a second end, an upper end, a lower end, a first portion defining an interior surface and an exterior surface, having a second texturized gripping region formed thereon proximate to or at the upper end of the second zipper strip, the second zipper strip having a second portion attached to the first portion by a hinge rotatably coupling the second portion to the first portion and defining the upper end defined by an upper surface of a second closure tab, the second closure tab of the second portion including an inwardly protruding second tab with a second closure tab end, the first portion of the second zipper strip including a plurality of second strip engagement protrusions on the interior surface of the first portion protruding inwardly therefrom and defining a recess between each two adjacent second strip engagement protrusion, the second zipper strip having no flange or portion of the second zipper strip extending upward beyond the upper surface portion of the second closure tab wherein the second texturized gripping region is formed on the exterior surface of the second zipper strip at least directly opposite each of the plurality of second strip engagement protrusions;

the first zipper strip having a first zipper length from a first end to a second end, an upper end, a lower end, an interior surface, and the exterior surface, the exterior surface of the first zipper assembly having a first texturized gripping region formed thereon proximate to or at the upper end of the first zipper strip, the first zipper strip having a first portion with an the upper end defined by an upper surface of a first closure tab, the first closure tab including an inwardly protruding first tab with a first closure tab end, the first zipper strip having a second portion including a plurality of first strip engagement protrusions on the interior surface protruding inwardly therefrom and defining a recess between each two adjacent first strip engagement protrusion and having a complementary shape configured for selectively receiving at least one of the second strip engagement protrusions of the second zipper strip, the first zipper strip having no flange or portion of the first zipper strip extending upward beyond the upper surface portion of the first closure tab, wherein a first upper most one of the two or more first strip engagement protrusions has an engagement member extending downward away from the upper end of the first zipper strip and an upper flat surface and is positioned adjacent to the first closure tab without having a protrusion receiving recess between the upper flat surface of the first strip engagement protrusion and the first closure tab, wherein the first texturized gripping region is formed on the exterior surface of the first zipper strip at least directly opposite each of the plurality of first strip engagement protrusions of the first zipper strip, wherein the first and second zipper strips are configured to mate by inserting each of the plurality of first engagement protrusion of the first zipper strip into the recesses of the second zipper strip along the definable length of the plastic zipper strip assembly to create a closure thereof, wherein both the first closure tab and the second closure tab are configured so that both abut against the upper surface of the first upper most first strip engagement protrusion, wherein the first closure tab and the second closure tab are configured so that the first closure tab end abuts the second closure tab end defining an opening point that is substantially closed by such abutment when the first and second zipper strips have been mated, and wherein the zipper assembly is affixed to the top end of the bag so that when the first and second zipper strips have been mated, the first and abutted first and second closure tab ends define the top end of the bag, and no portion of the bag extends upward or beyond the abutted first and second closure tab ends, and wherein the first and second zipper assemblies do not have any inwardly projecting features that engage or contact or abut other than the abutting top end closure tabs and the engagement protrusions and recesses.

13. The bag of claim 12, wherein the hinge is configured as a bridge of plastic material at or near the upper end of the first portion of the first zipper strip.

14. The bag of claim 12, wherein each recess and first strip engagement protrusion of the first zipper strip is complementary in shape to the recesses and second strip engagement protrusions of the second zipper strip such that the zipper strips may be mated to create a closure of the zipper assembly.

15. The zipper assembly of claim 1, wherein the texturized gripping regions of each zipper strip is continuous from a position proximate upper surface of each zipper strip downward to a position proximate to or lower than the lower most first strip and second strip engagement protrusions of the first and second zipper strips, respectively, and each runs the length of the zipper assembly on the exterior surfaces opposing each of the first and second closure tabs of the plastic zipper assembly.

16. The bag of claim 9, wherein the texturized gripping regions of each zipper strip is continuous from a position proximate to the upper surface of each zipper strip downward to a position proximate to or lower than the lower most first strip and second strip engagement protrusions of the first and second zipper strips, respectively, and each runs the length of the zipper assembly on the exterior surfaces opposing each of the first and second closure tabs.

17. The bag of claim 12, wherein the texturized gripping regions of each zipper strip is continuous from a position proximate to the upper surface of each zipper strip downward to a position proximate to or lower than the lower most first strip and second strip engagement protrusions protrusion of the first and second zipper strips, respectively, and each runs the length of the zipper assembly on the exterior surfaces opposing each of the first and second closure tabs.

18. The bag of claim 12 wherein the texturized gripping regions of each zipper strip is formed on the exterior surface of the first portion of the first zipper strip laterally from a position above or aligned proximate with the first closure tab and to a position proximate to or below the two adjacent first strip and second strip engagement protrusions of the second portion of the first zipper strip, and the texturized gripping region of the first zipper strip is formed on the exterior surface of the second zipper strip at a position above or aligned proximate with and opposing the upper most one of the plurality of first strip engagement protrusions formed in the interior surface thereof and extending laterally therefrom on the outer surface opposing all of the plurality of first strip engagement protrusions.

* * * * *